US006919860B2

(12) United States Patent
Tsai et al.

(10) Patent No.: US 6,919,860 B2
(45) Date of Patent: Jul. 19, 2005

(54) MULTI-FREQUENCY ANTENNA FOR A PORTABLE ELECTRONIC APPARATUS

(75) Inventors: Tiao-Hsing Tsai, Taipei (TW); Huang-Tse Peng, Hsi-Chih (TW); Chien-Pin Chiu, Yun-Lin Hsien (TW); Kai Shih, Taipei (TW)

(73) Assignee: Quanta Computer Inc., Tao-Yuan Hsien (TW)

( * ) Notice: Subject to any disclaimer, the term of this patent is extended or adjusted under 35 U.S.C. 154(b) by 13 days.

(21) Appl. No.: 10/751,281

(22) Filed: Dec. 30, 2003

(65) Prior Publication Data

US 2004/0239579 A1 Dec. 2, 2004

(30) Foreign Application Priority Data

May 27, 2003 (TW) ..... 92209708 U

(51) Int. Cl.[7] ..... H01Q 1/36; H01Q 1/24
(52) U.S. Cl. ..... 343/895; 343/702
(58) Field of Search ..... 343/702, 741, 343/742, 743, 767, 769, 845, 895

(56) References Cited

U.S. PATENT DOCUMENTS 6,593,886 B2 * 7/2003 Schantz ..... 343/700 MS
6,628,241 B1 * 9/2003 Fukushima et al. ..... 343/895
6,642,895 B2 * 11/2003 Zurcher et al. ..... 343/718
6,693,598 B1 * 2/2004 Bishop et al. ..... 343/741

* cited by examiner

*Primary Examiner*—Shih-Chao Chen
*Assistant Examiner*—Minh Dieu A
(74) *Attorney, Agent, or Firm*—Ladas & Parry LLP

(57) ABSTRACT

A multi-frequency antenna includes a first antenna element having a first antenna member for receiving and transmitting signals in a first frequency band and a second antenna member for receiving and transmitting signals in a second frequency band. The first antenna member has opposite first and second ends. The second antenna member has opposite third and fourth ends respectively disposed adjacent to and remote from the first end of the first antenna member. The fourth end of the second antenna member is connected electrically to the first end of the first antenna member so as to form a feed point. A C-shaped second antenna element has opposite ends, one of which is connected electrically to the third end of the second antenna member of the first antenna element.

5 Claims, 13 Drawing Sheets

H-plane at GSM band

E1-plane at GSM band

E2-plane at GSM band

H-plane at DCS band

E1-plane at DCS band

E2-plane at DCS band

H-plane at PCS band

E1-plane at PCS band

E2-plane at PCS band

MULTI-FREQUENCY ANTENNA FOR A PORTABLE ELECTRONIC APPARATUS

CROSS-REFERENCE TO RELATED APPLICATION

This application claims priority of Taiwanese Application No. 092209708, filed on May 27, 2003.

BACKGROUND OF THE INVENTION

1. Field of the Invention

The invention relates to an antenna, more particularly to a multi-frequency antenna for a portable electronic apparatus.

2. Description of the Related Art

FIG. 1 illustrates a conventional multi-frequency antenna 1 for a mobile phone (not shown) that can receive and transmit signals in high and low frequency bands. The conventional antenna 1 includes a straight high-frequency antenna member 11, and a serpentine low-frequency antenna member 12 connected to the antenna member 11. In view of the current trend toward making the size of the mobile phone as small as possible, the design of the conventional multi-frequency antenna 1 must be modified to ensure effective low-frequency radiation.

SUMMARY OF THE INVENTION

Therefore, the object of the present invention is to provide a multi-frequency antenna for a portable electronic apparatus that can provide an enhanced radiation effect.

According to the present invention, a multi-frequency antenna comprises:

a first antenna element having a first antenna member for receiving and transmitting signals in a first frequency band, the first antenna member having opposite first and second ends, and a second antenna member for receiving and transmitting signals in a second frequency band, the second antenna member having opposite third and fourth ends respectively disposed adjacent to and remote from the first end of the first antenna member, the fourth end of the second antenna member being connected electrically to the first end of the first antenna member so as to form a feed point at a junction of the fourth end of the second antenna member and the first end of the first antenna member; and a C-shaped second antenna element having opposite ends, one of which is connected electrically to the third end of the second antenna member of the first antenna element.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
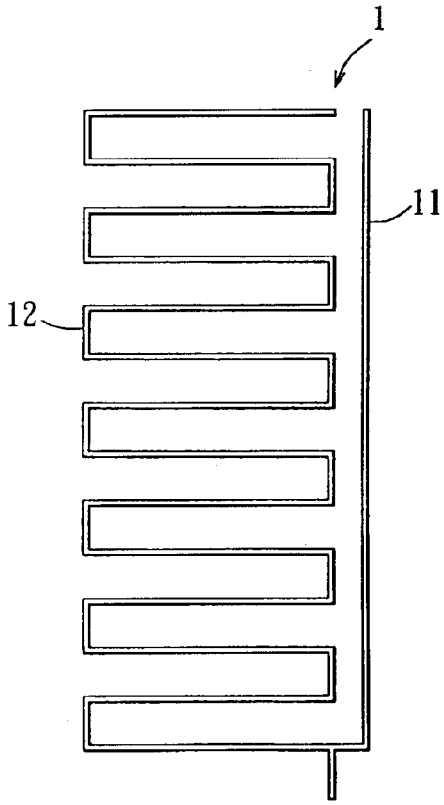
FIG. 1 PRIOR ART
FIG. 1 is a schematic view showing a conventional multi-frequency antenna.
Figure 2:
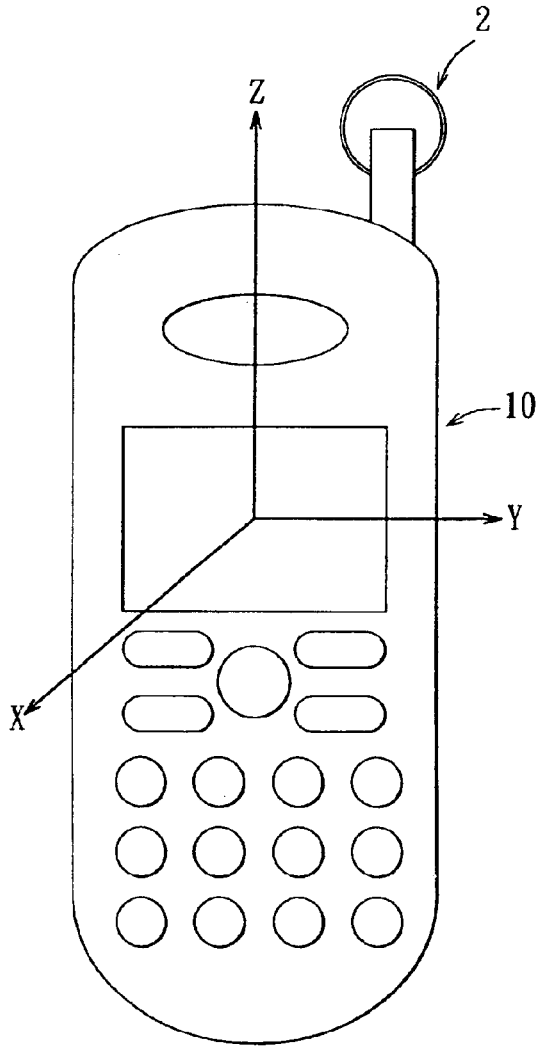
FIG. 2 is a perspective view showing a mobile phone assembled with the first preferred embodiment of a multi-frequency antenna according to the present invention.
Figure 3:
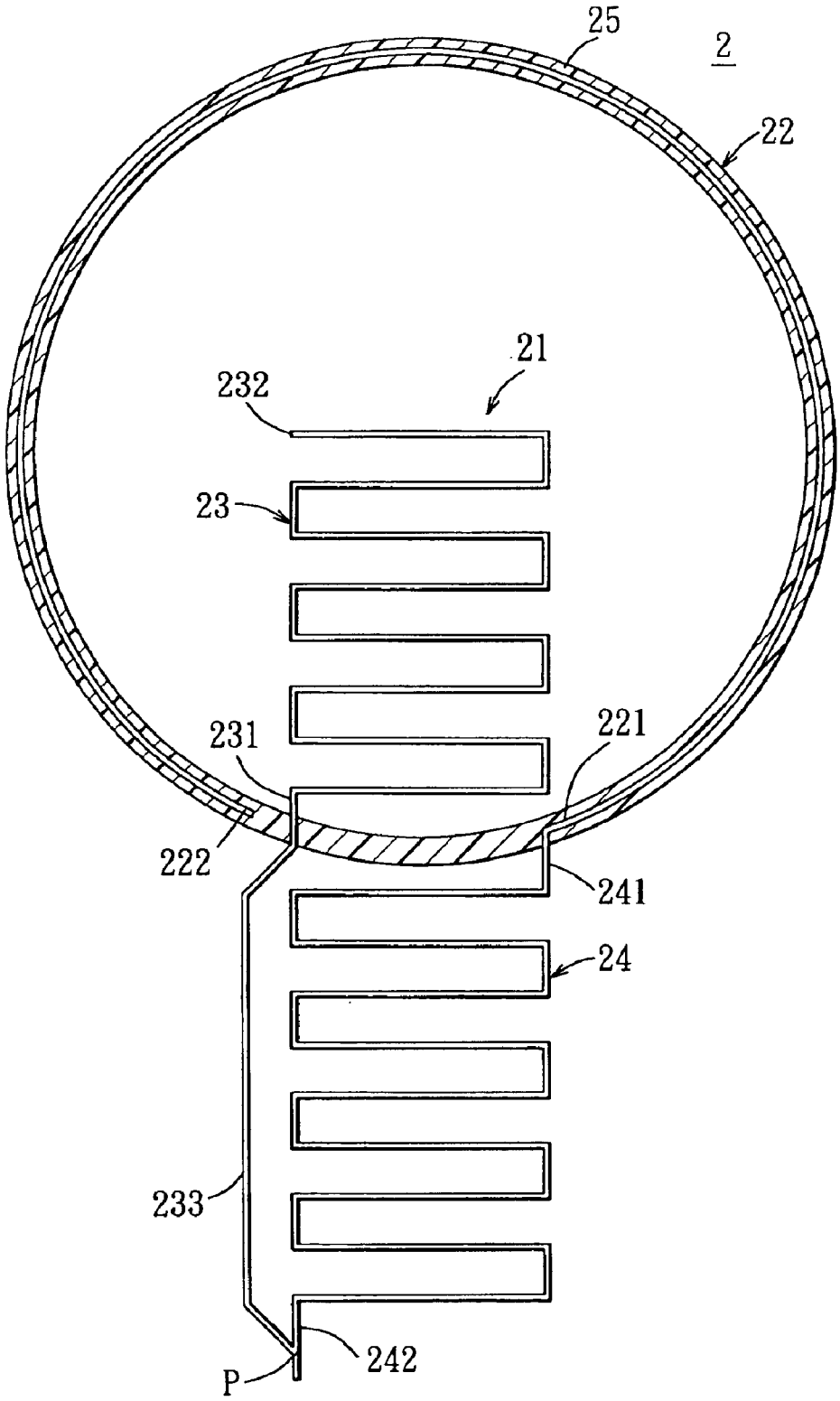
FIG. 3 is a schematic, partly sectional view showing the first preferred embodiment.

Referring to FIGS. 2 and 3, the first preferred embodiment of a multi-frequency antenna 2 for a mobile phone 10 according to the present invention is shown to include a first antenna element 21, and a C-shaped second antenna element 22.

The first antenna element 21, which is received in an insulating case (not shown), has a first antenna member 23 for receiving and transmitting signals, such as high-frequency signals, in a first frequency band, and a second antenna member 24 for receiving and transmitting signals, such as low-frequency signals, in a second frequency band. The first antenna member 23 has opposite first and second ends 231, 232. The second antenna member 24 has opposite third and fourth ends 241, 242 respectively disposed adjacent to and remote from the first end 231 of the first antenna member 23. The fourth end 242 of the second antenna member 24 is connected electrically to the first end 231 via an extending portion 233, which extends from the first end 231 of the first antenna member 23 toward the fourth end 242 of the second antenna member 24, so as to form a feed point (P) at a junction of the fourth end 242 of the second antenna member 24 and the extending portion 233. In this embodiment, each of the first and second antenna members 23, 24 has a serpentine configuration.

The second antenna element 22 is covered by an insulating sleeve 25, and has opposite ends 221, 222, one of which is connected electrically to the third end 241 of the second antenna member 24 of the first antenna element 21. In this embodiment, the first antenna member 23 of the first antenna element 21 is surrounded by the second antenna element 22, and the first and second antenna elements 21, 22 are disposed in a common plane.

Figure 4:
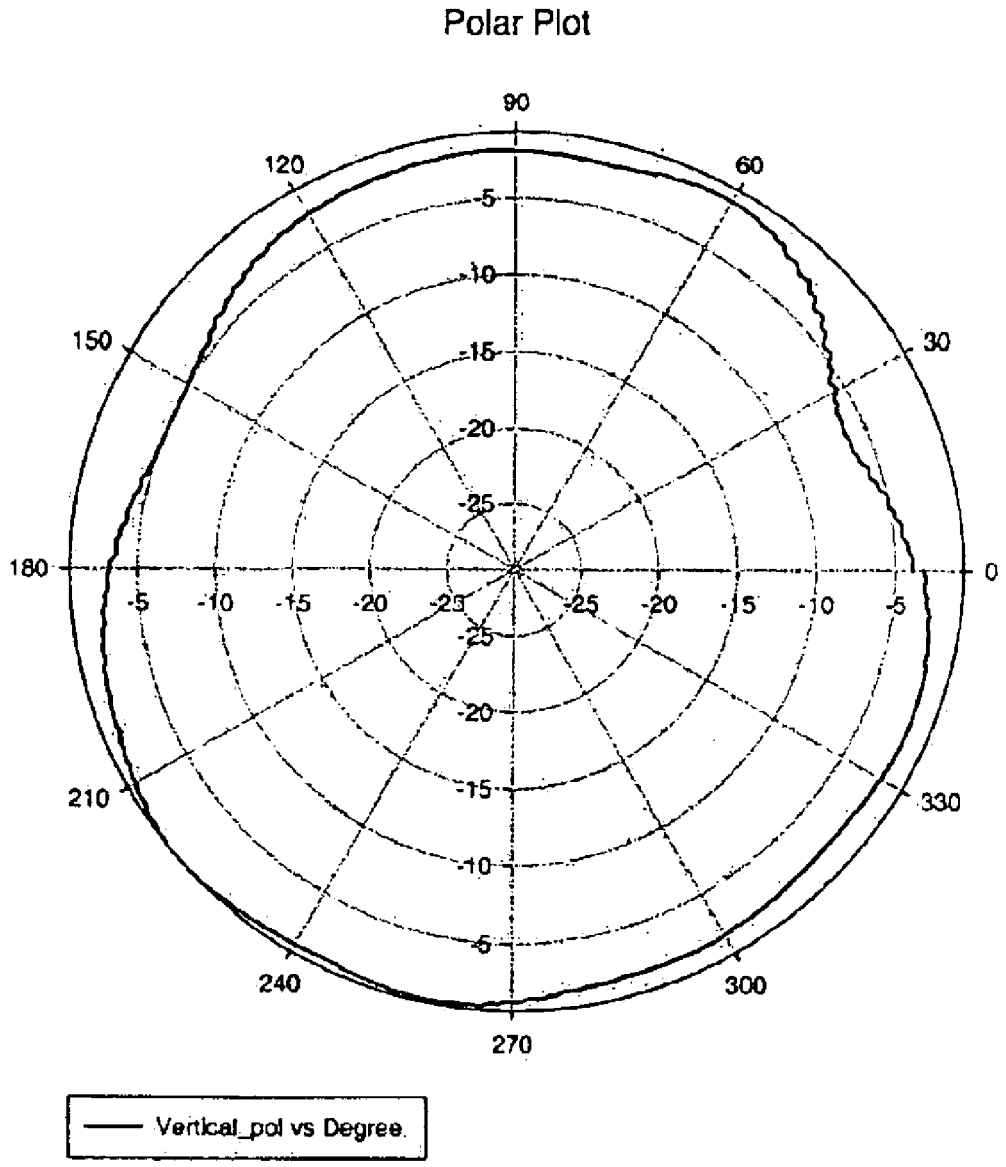
FIGS. 4 to 6 are gain charts of the first preferred embodiment in an H-plane, an E1-plane and an E2-plane at an operating frequency of 900 MHz, respectively.
Figure 5:
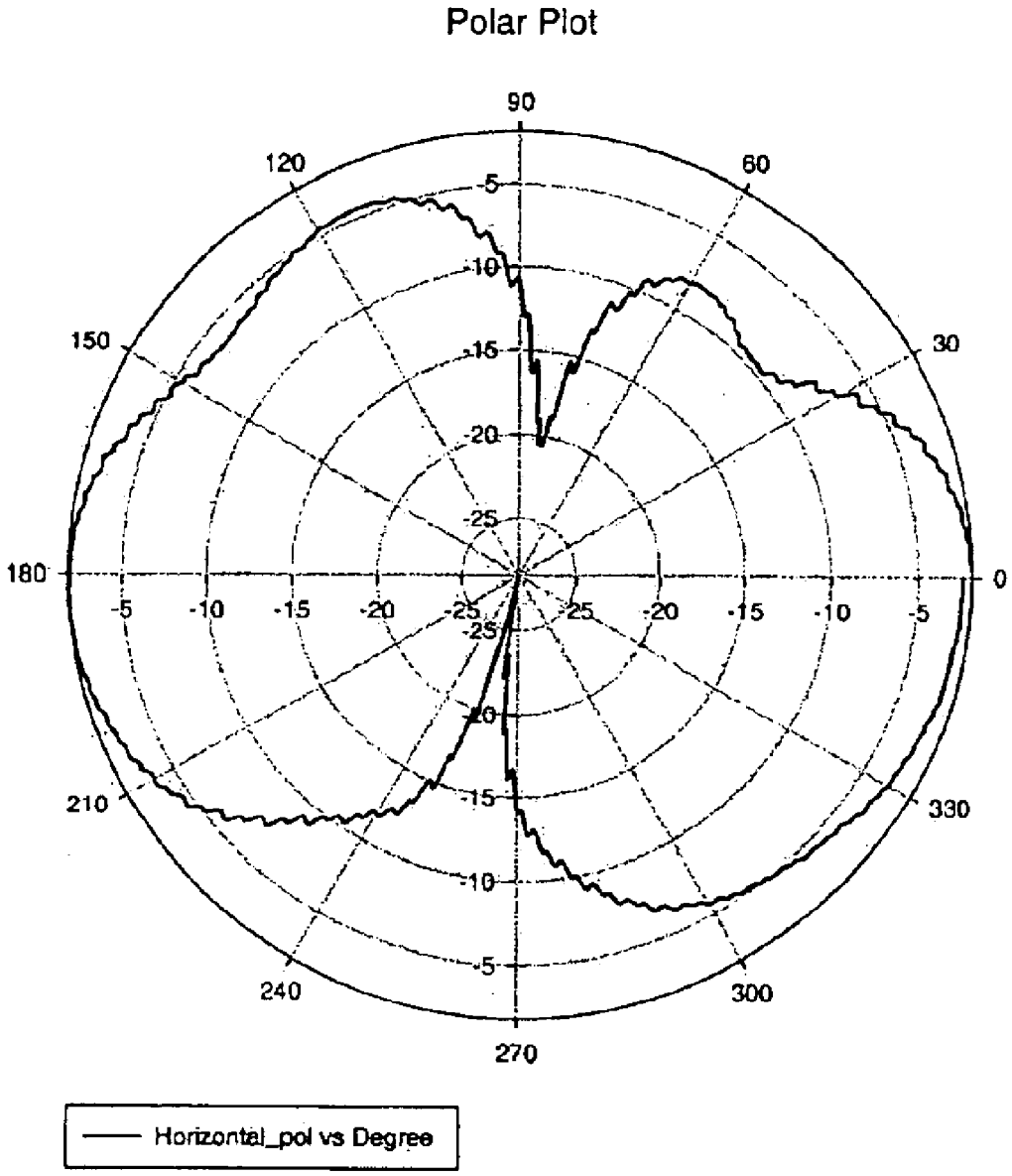
Figure 6:
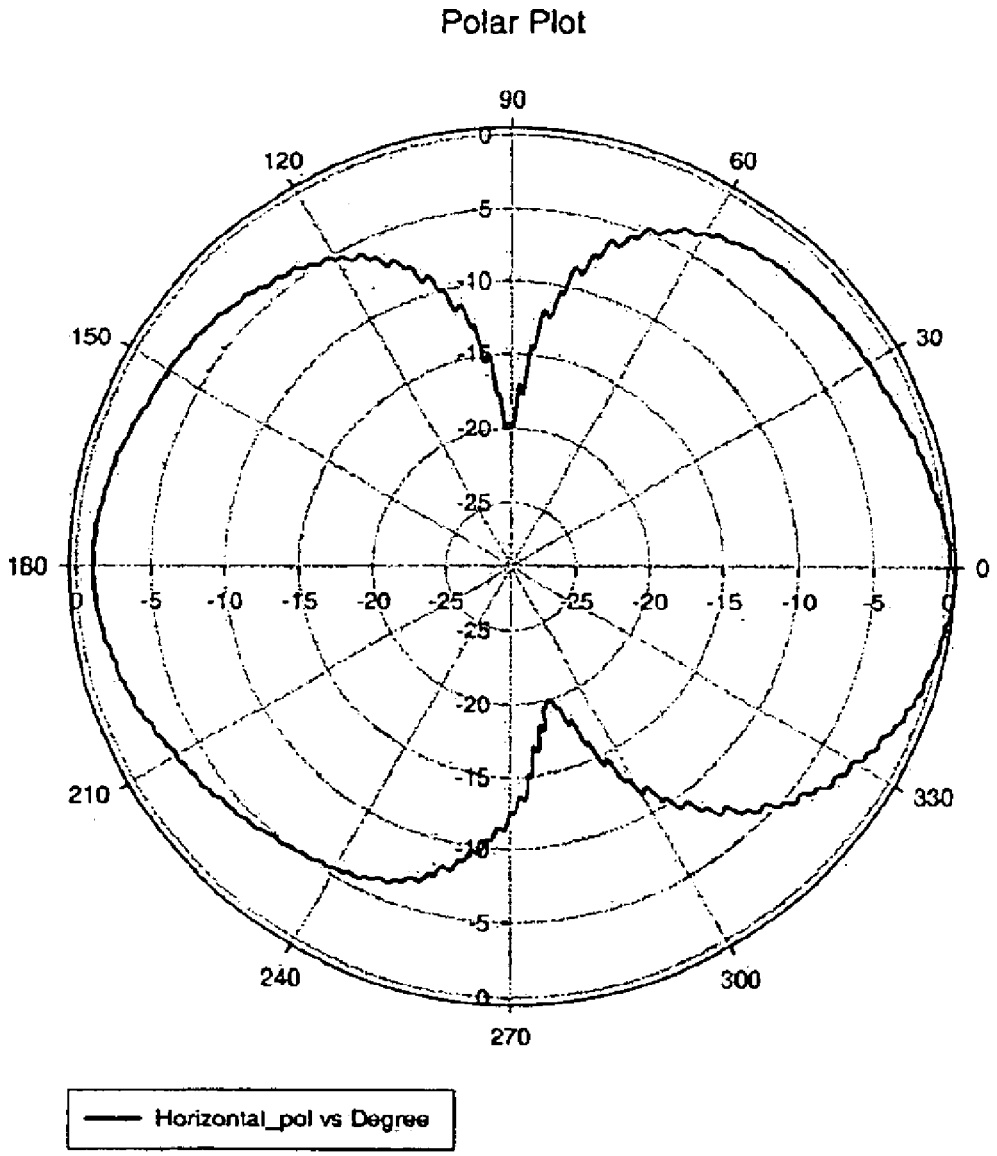
Figure 7:
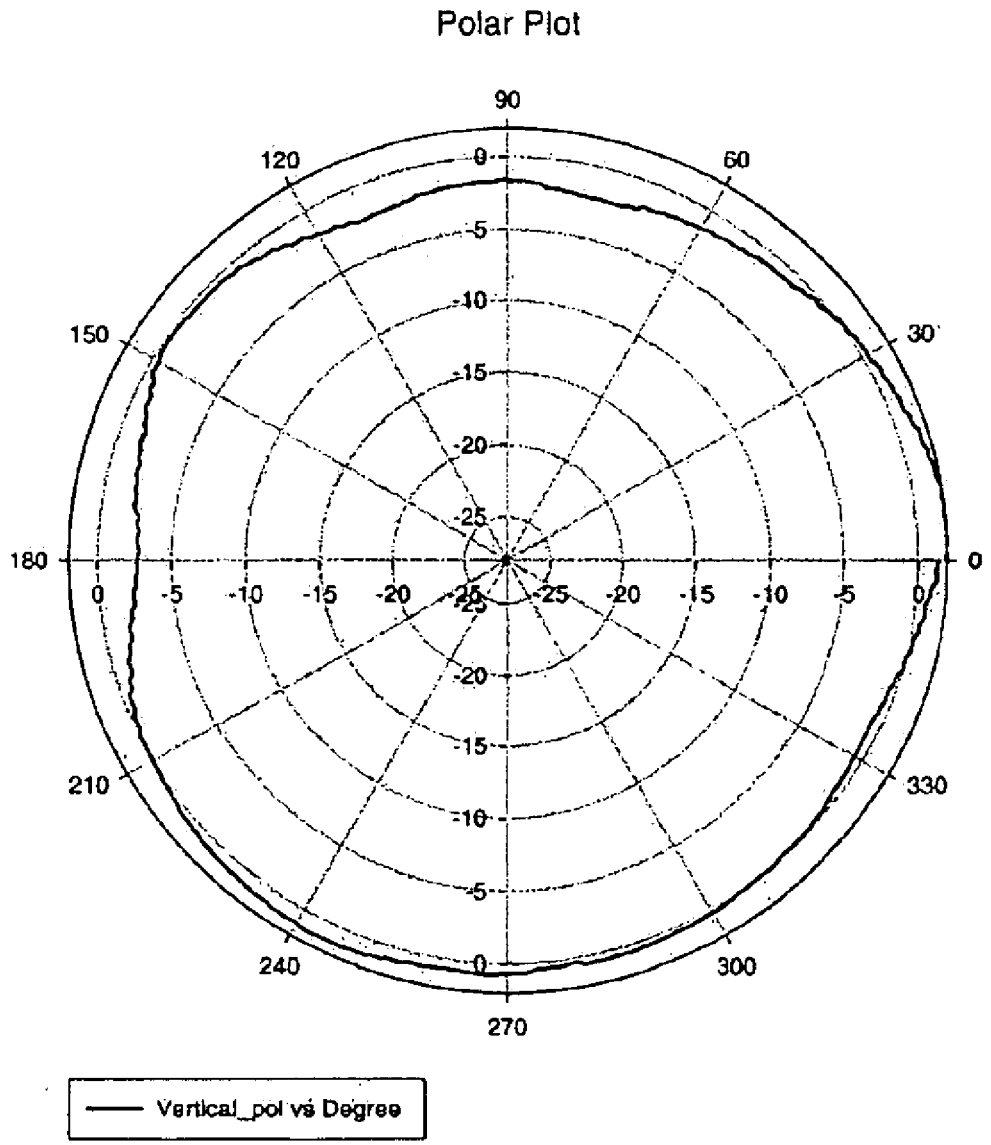
FIGS. 7 to 9 are gain charts of the first preferred embodiment in an H-plane, an E1-plane and an E2-plane at an operating frequency of 1800 MHz, respectively.
Figure 8:
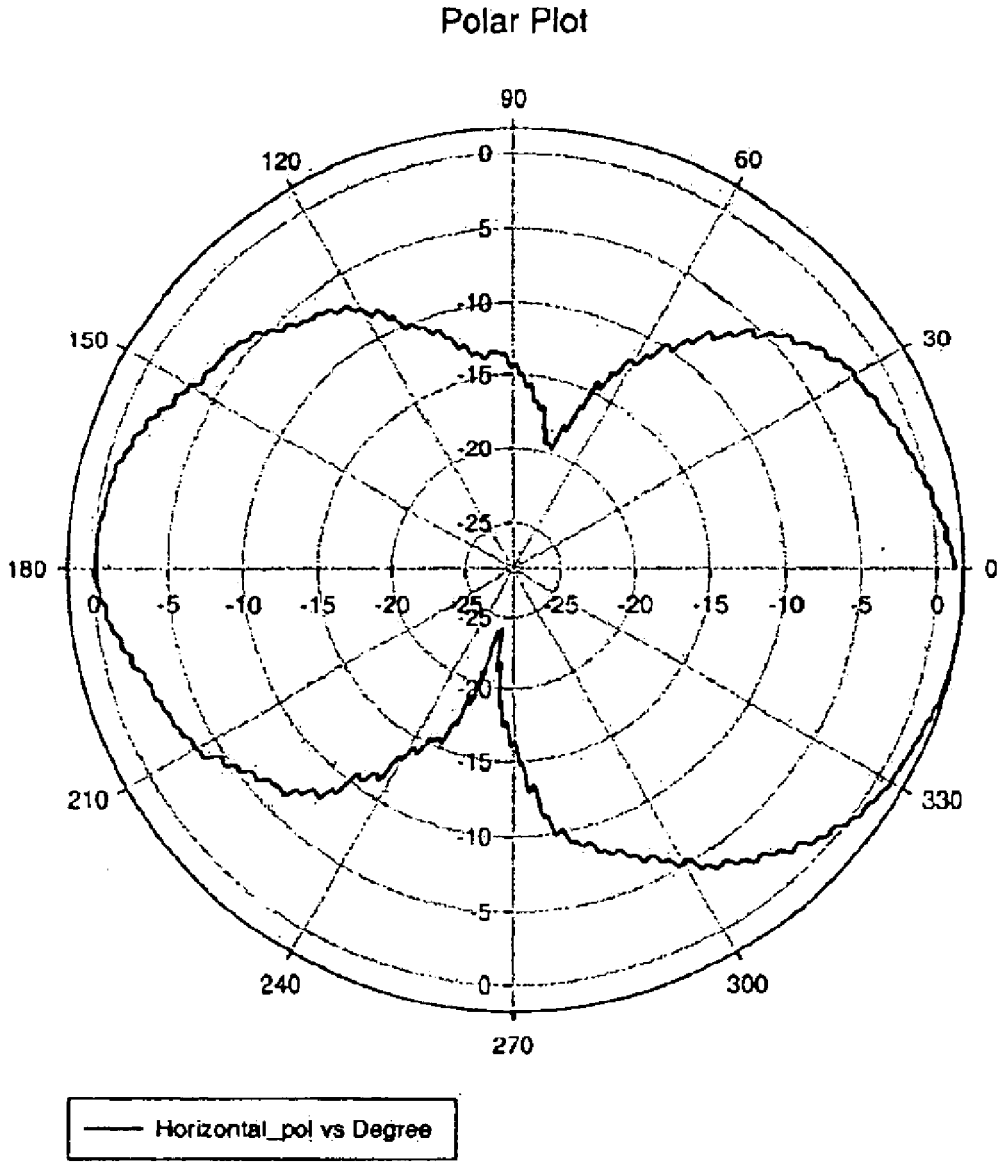
Figure 9:
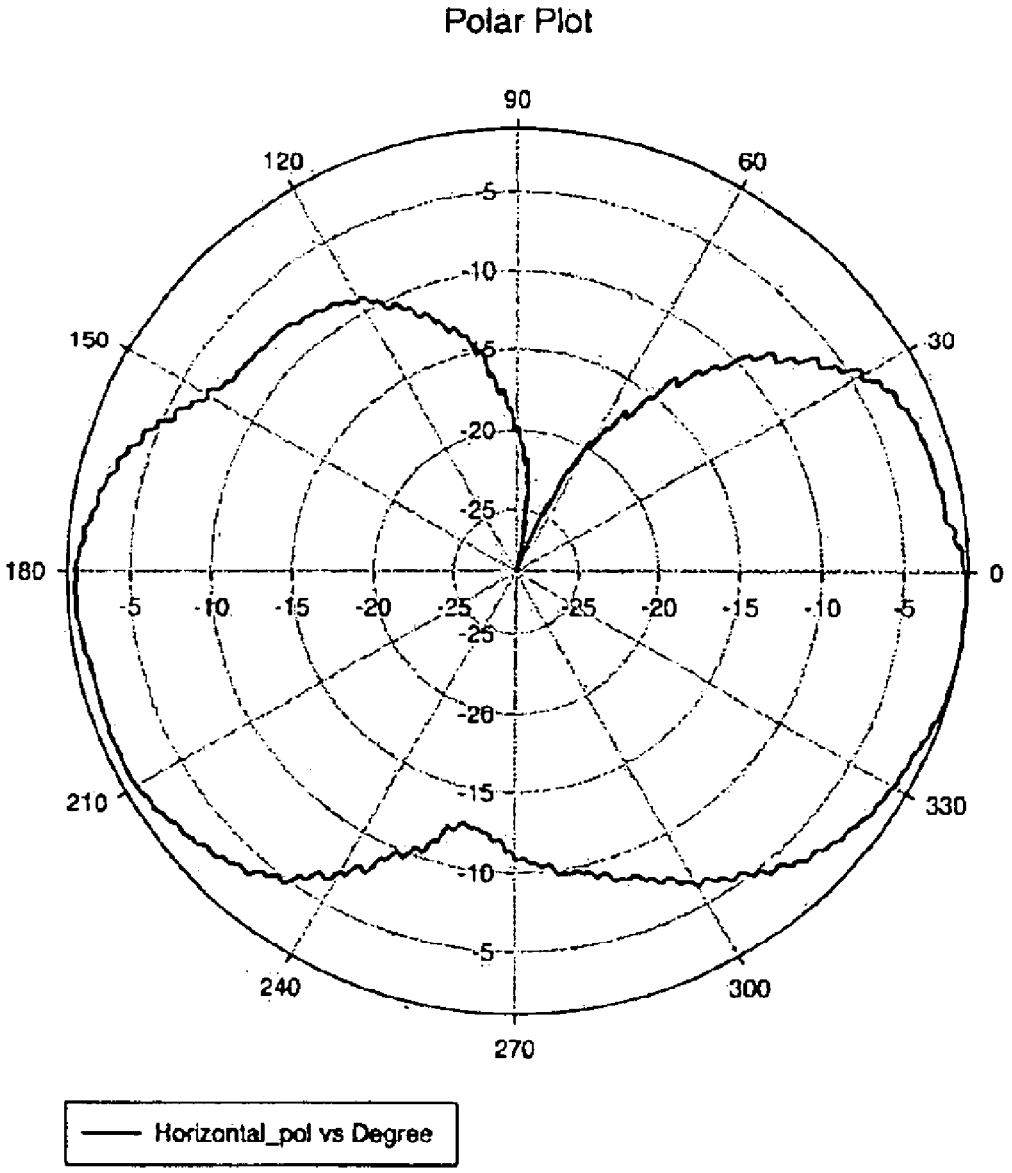
Figure 10:
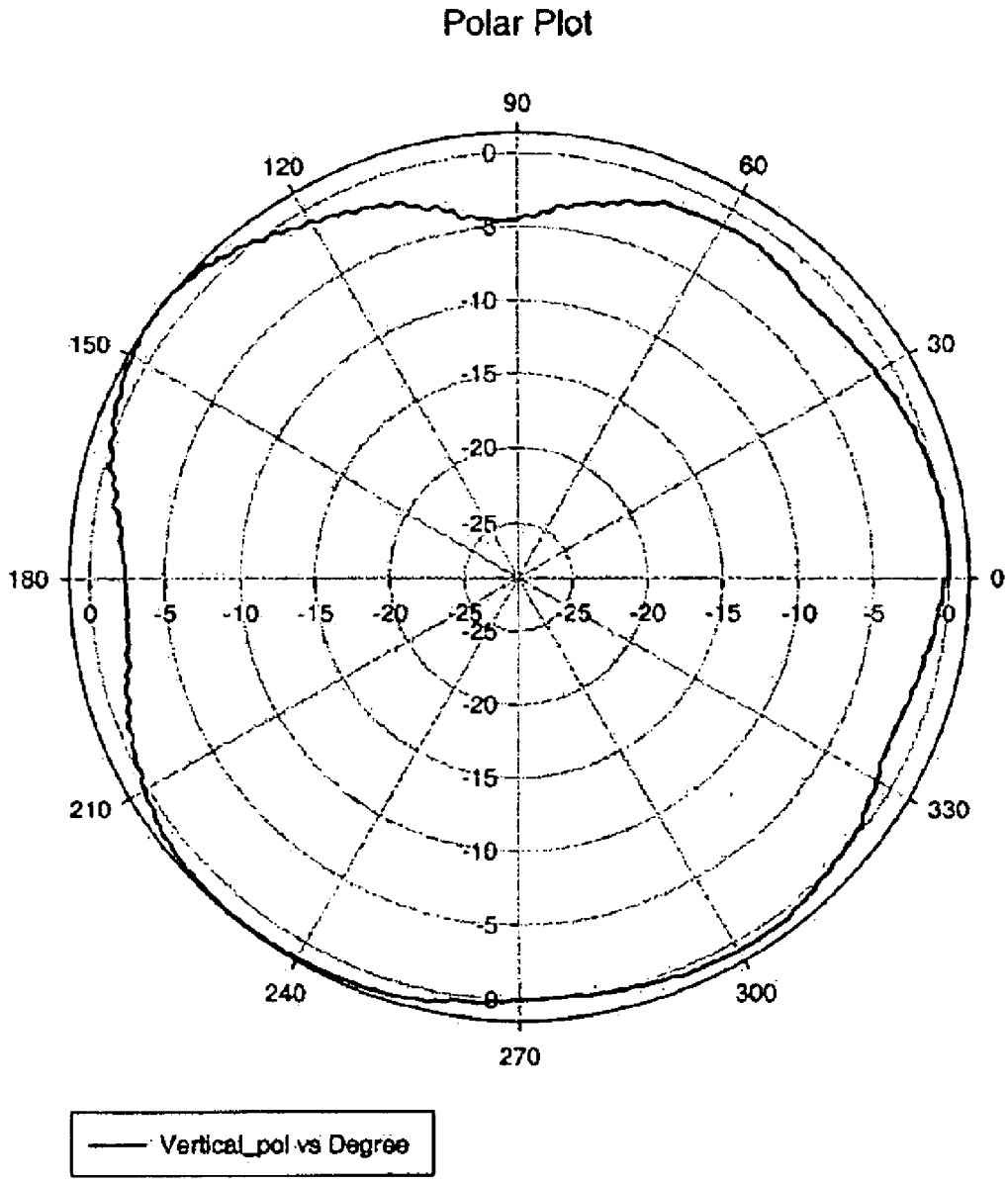
FIGS. 10 to 12 are gain charts of the first preferred embodiment in an H-plane, an E1-plane and an E2-plane at an operating frequency of 1900 MHz, respectively.
Figure 11:
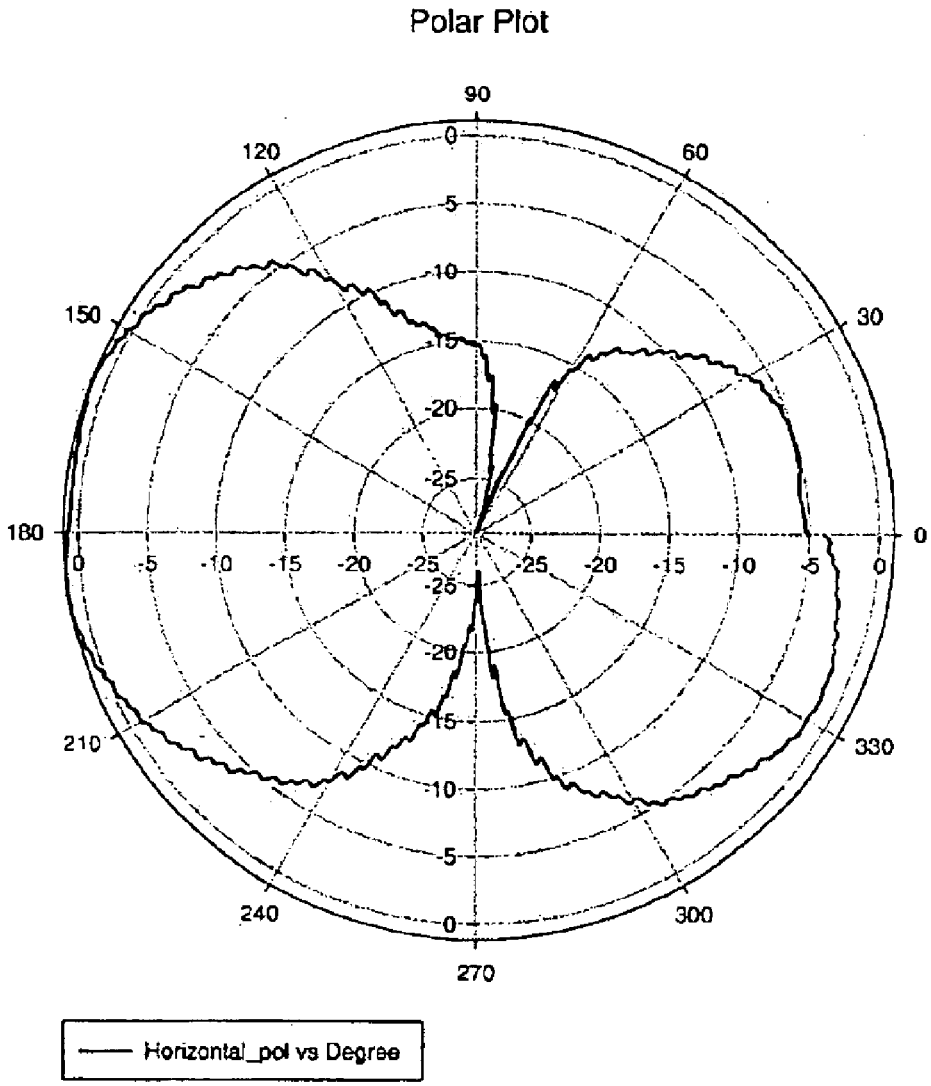
Figure 12:
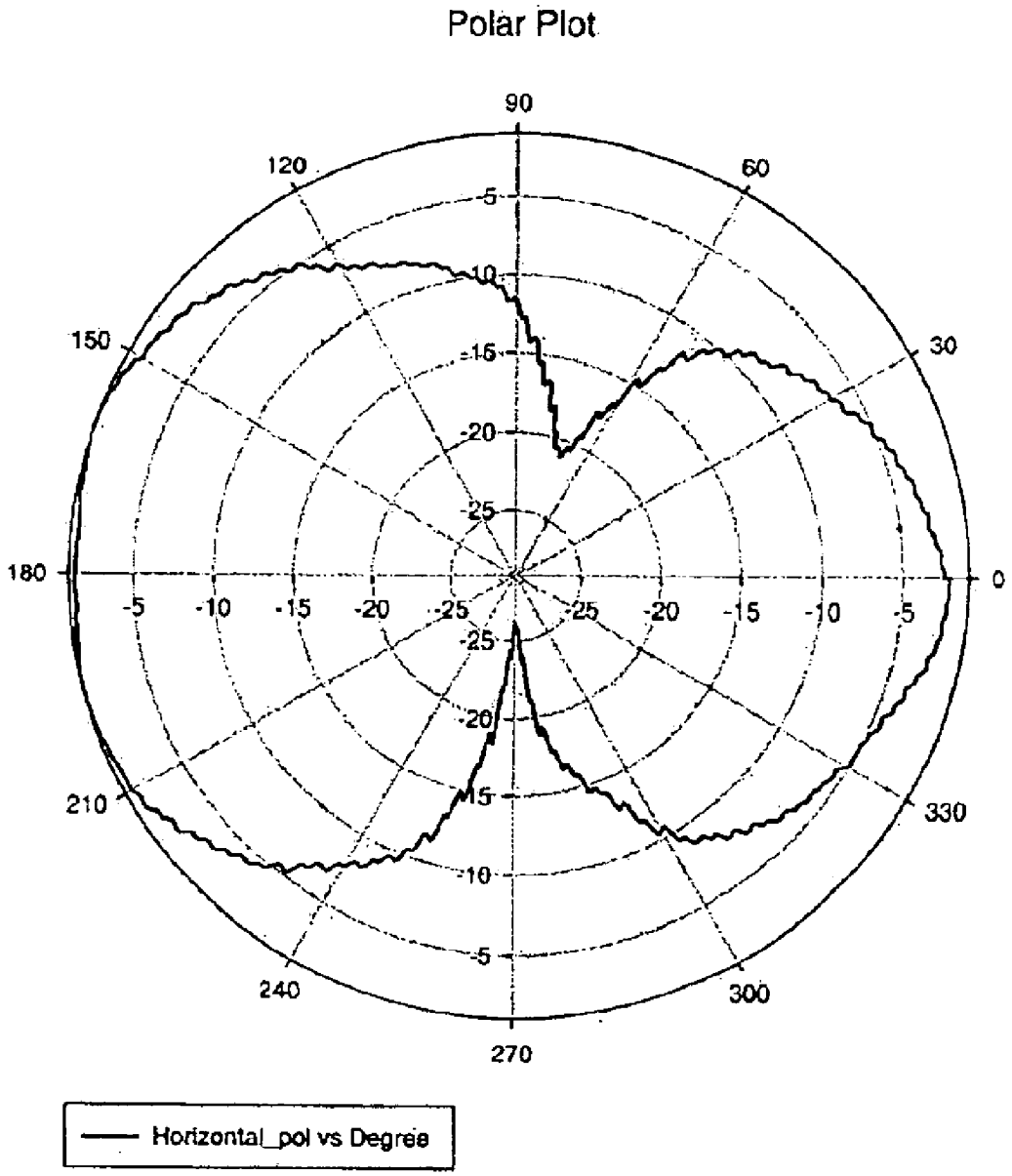

As shown in FIG. 2, it is assumed that the multi-frequency antenna 2 extends in a Z direction, that a display panel of the mobile phone 10 is directed in an X direction transverse to the Z direction, and that a Y direction is transverse to the X and Z directions. As such, an XY-plane represents an H-plane, a YZ-plane represents an E1-plane, and an XZ-plane represents an E2-plane. FIGS. 4 to 6 illustrate gain charts of the first preferred embodiment in the H-plane, the E1-plane and the E2-plane at a first operating frequency band (900 MHz), respectively. FIGS. 7 to 9 illustrate gain charts of the first preferred embodiment in the H-plane, the E1-plane and the E2-plane at a second operating frequency band (1800 MHz), respectively. FIGS. 10 to 12 illustrate gain charts of the first preferred embodiment in the H-plane, the E1-plane and the E2-plane at a third operating frequency band (1900 MHz), respectively.

Figure 13:
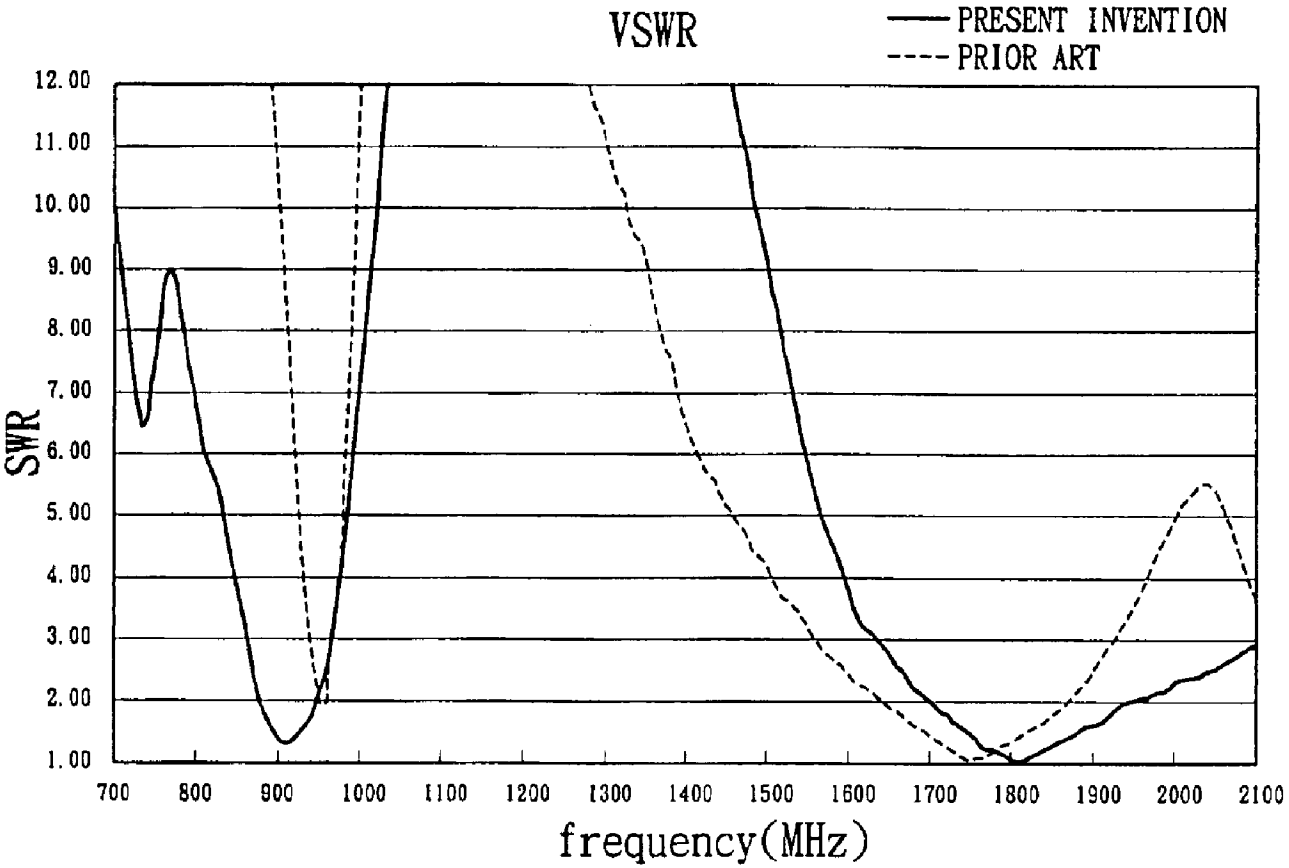
FIG. 13 shows VSWR charts of the first preferred embodiment and the conventional multi-frequency antenna.

Furthermore, FIG. 13 shows the voltage standing wave ratio (VSWR) for the antenna 2 of the present invention and the aforesaid conventional antenna 1. In the chart, the antenna 2 of the present invention has VSWR values at operating frequencies of 900 MHz and 1800 MHz less than those of the aforesaid conventional antenna 1 at operating frequencies of 950 MHz and 1750 MHz. Particularly, the antenna 2 of the present invention has a VSWR value at the operating frequency of 900 MHz apparently less than that of the aforesaid conventional antenna 1 such that the antenna 2 of the present invention can provide an enhanced radiation effect at the operating frequency of 900 MHz.

Figure 14:
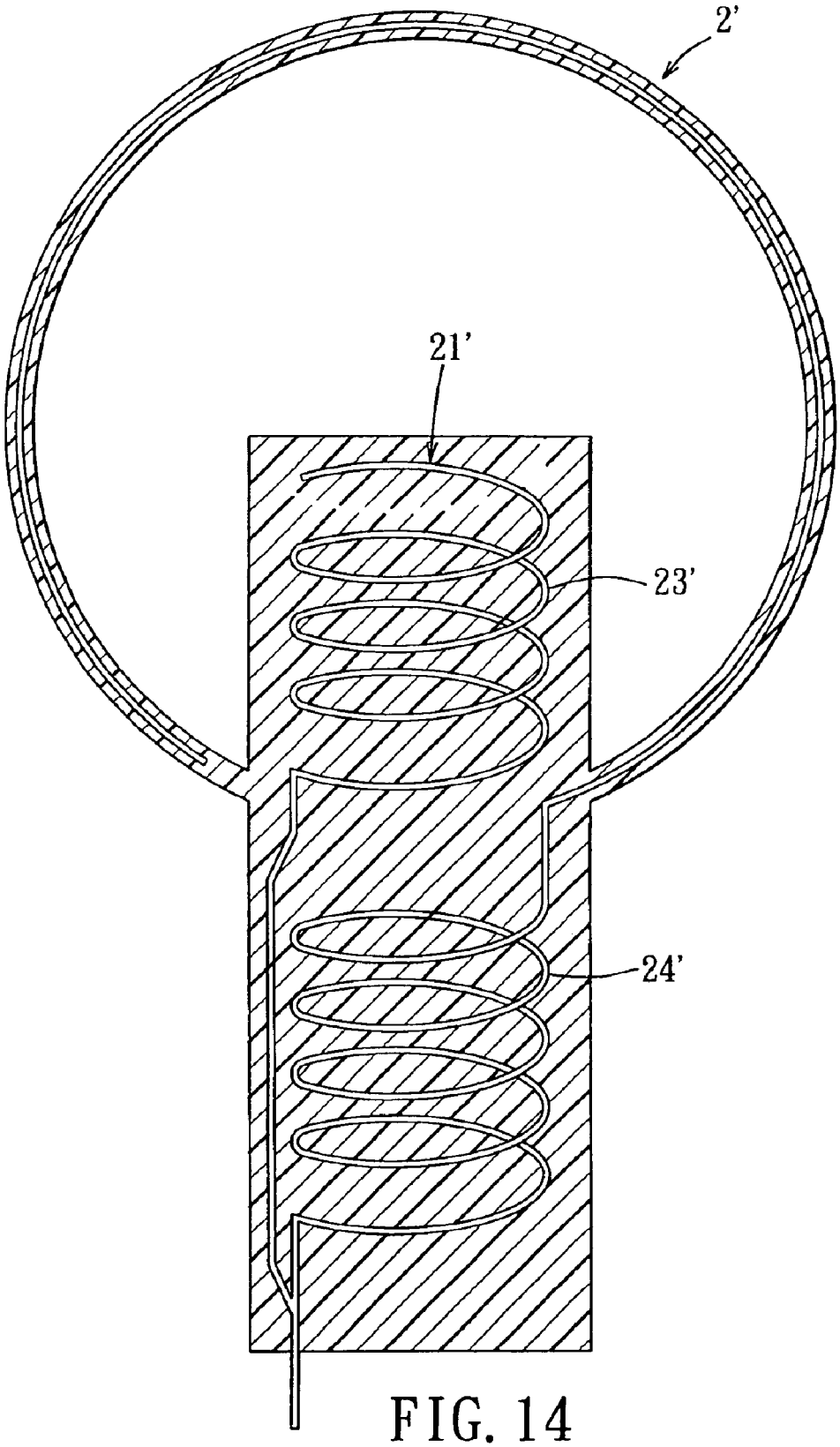
FIG. 14 is a schematic view showing the second preferred embodiment of a multi-frequency antenna according to the present invention.

FIG. 14 illustrates the second preferred embodiment of a multi-frequency antenna 2' according to this invention, which is a modification of the first preferred embodiment. Unlike the embodiment of FIG. 3, each of the first and second antenna members 23', 24' of the first antenna element 21' has a helical configuration.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A multi-frequency antenna comprising:

a first antenna element having a first antenna member for receiving and transmitting signals in a first frequency band, said first antenna member having opposite first and second ends, and a second antenna member for receiving and transmitting signals in a second frequency band, said second antenna member having opposite third and fourth ends respectively disposed adjacent to and remote from said first end of said first antenna member, said fourth end of said second antenna member being connected electrically to said first end of said first antenna member so as to form a feed point at a junction of said fourth end of said second antenna member and said first end of said first antenna member; and a C-shaped second antenna element having opposite ends, one of which is connected electrically to said third end of said second antenna member of said first antenna element.

2. The multi-frequency antenna as claimed in claim 1, wherein said first and second antenna elements are disposed in a common plane.

3. The multi-frequency antenna as claimed in claim 1, wherein said first antenna member of said first antenna element is surrounded by said second antenna element.

4. The multi-frequency antenna as claimed in claim 1, wherein at least one of said first and second antenna members has a serpentine configuration.

5. The multi-frequency antenna as claimed in claim 1, wherein at least one of said first and second antenna members has a helical configuration.

* * * * *